US009314822B2

(12) United States Patent
Berdelle-Hilge

(10) Patent No.: US 9,314,822 B2
(45) Date of Patent: Apr. 19, 2016

(54) SORTING SYSTEM AND SORTING METHOD WITH TWO STORAGE AREAS

(71) Applicant: SIEMENS AKTIENGESELLSCHAFT, Munich (DE)

(72) Inventor: Peter Berdelle-Hilge, Konstanz (DE)

(73) Assignee: Siemens Aktiengesellschaft, Munich (DE)

( * ) Notice: Subject to any disclaimer, the term of this patent is extended or adjusted under 35 U.S.C. 154(b) by 65 days.

(21) Appl. No.: 14/354,713

(22) PCT Filed: Oct. 24, 2012

(86) PCT No.: PCT/EP2012/071048

§ 371 (c)(1),
(2) Date: Apr. 28, 2014

(87) PCT Pub. No.: WO2013/060721

PCT Pub. Date: May 2, 2013

(65) Prior Publication Data

US 2014/0291217 A1 Oct. 2, 2014

(30) Foreign Application Priority Data

Oct. 28, 2011 (DE) ..... 10 2011 085 458

(51) Int. Cl.
*B07C 5/00* (2006.01)
*B07C 5/02* (2006.01)
*B07C 5/36* (2006.01)
(Continued)

(52) U.S. Cl.
CPC ... *B07C 5/02* (2013.01); *B07C 3/00* (2013.01); *B07C 5/362* (2013.01); *B07C 3/082* (2013.01)

(58) Field of Classification Search
CPC ..... B07C 3/06; B07C 3/065; B07C 3/08; B07C 3/082; B07C 3/085; B07C 5/361; B07C 5/362; B07C 5/38
See application file for complete search history.

(56) References Cited

U.S. PATENT DOCUMENTS 4,244,672 A * 1/1981 Lund ..... B07C 3/02 198/349.7
5,277,321 A 1/1994 Nagasawa
5,577,596 A * 11/1996 Van Essen ..... B07C 3/02 198/349
(Continued)

FOREIGN PATENT DOCUMENTS

DE 102008012027 A1 10/2009
EP 0575032 A2 12/1993
(Continued)

*Primary Examiner* — Joseph C Rodriguez
(74) *Attorney, Agent, or Firm* — Laurence Greenberg; Werner Stemer; Ralph Locher

(57) ABSTRACT

Objects are sorted according to a predetermined sorting feature. A first storage area and a second storage area each have a plurality of storage devices. A storage device of the first storage area has a storage device output and an emptying transport path, which leads to a storage device of the second storage area. The value that the sorting feature takes on for each object to be sorted is measured for that object. A storage device is selected on the basis of the sorting feature value. In an emptying-optimized mode, only storage devices of the first storage area are selected, and in a sorting destination-optimized mode, storage devices of the second storage area are also selected. A storage device with a store output is emptied in an emptying-optimized mode by transporting objects in this storage device to a storage device of the second storage area via the emptying transport path.

9 Claims, 7 Drawing Sheets

(51) Int. Cl.
*B07C 3/00* (2006.01)
*B07C 3/08* (2006.01)

(56) References Cited

U.S. PATENT DOCUMENTS 6,054,666 A * 4/2000 Yamashita ..... B07C 3/02 209/583
6,677,548 B2 1/2004 Robu
7,080,739 B2 7/2006 Guy
7,126,074 B1 10/2006 Berceli
7,138,596 B2 * 11/2006 Pippin ..... B07C 3/02 209/584
7,820,932 B2 10/2010 Stemmle
8,011,516 B2 9/2011 Berdelle-Hilge
8,374,720 B2 * 2/2013 Kechel ..... B07C 3/02 209/542
8,457,781 B2 * 6/2013 Bailey ..... B07C 3/00 700/224
8,766,128 B2 * 7/2014 Stemmle ..... B07C 3/08 209/584
8,955,688 B2 * 2/2015 Berdelle-Hilge ..... B07C 3/02 198/465.4
8,965,566 B2 * 2/2015 Berdelle-Hilge ..... B07C 3/02 700/213
9,044,786 B2 * 6/2015 Stemmle ..... B07C 3/082
2003/0141226 A1 * 7/2003 Morikawa ..... B07C 5/18 209/584
2007/0151904 A1 * 7/2007 Hanson ..... B07C 3/02 209/584
2009/0145819 A1 6/2009 Zimmermann
2014/0299520 A1 * 10/2014 Stemmle ..... B07C 3/08 209/509

FOREIGN PATENT DOCUMENTS

EP 1878511 A1 1/2008
EP 2067536 A1 6/2009
WO 0112347 A1 2/2001

* cited by examiner

SORTING SYSTEM AND SORTING METHOD WITH TWO STORAGE AREAS

BACKGROUND OF THE INVENTION

Field of the Invention

The invention relates to a sorting system and a sorting method for sorting in two modes and with use of two spatially separate storage areas, in particular for flat postal items. By means of the sorting system and as a result of the sorting method, a number of objects are sorted according to a predetermined sorting feature, in particular postal items are sorted according to their delivery addresses.

A method and a device for sorting articles ("objects") are described in U.S. Pat. No. 6,677,548 B2. By means of a "loading station 2", the "objects" are fed to a conveying arrangement; see FIG. 1. A "first transfer section 9" connects the "loading station 2" to the "parking sections 7" of a block A. A "second transfer section 10" connects the "sections 7" of the block A to the "parking sections 8" of a block B. A "discharge section 12" connects the block B to a "discharge station 13". An embodiment with a "buffer section 20" is shown in FIG. 3. The "parking sections" of the block A are denoted by A.1, A.2, etc., and the "parking sections" of the block B are denoted by B.1, B.2, etc. the "buffer section 20" has many "buffer storage device parking sections 21" and a "return section 22". In the embodiment of FIG. 4, the "buffer section 20" is formed as a meandering conveying path ("closed circuit 23"). FIG. 5 shows how the sorting system of FIG. 1 sorts 16 various objects in four sorting runs. In the first sorting run the eight objects 1, 3, 5, etc. are brought into the "parking section A.1", and the eight remaining objects 2, 4, 6, etc. are brought into the "parking section A.2". In the second sorting run the 16 objects are brought to the two "parking sections B.1, B.2", are brought again into the "parking sections A.1, A.2" in the third sorting run, and are brought again into the "parking sections B.1, B.2" in the fourth sorting run. After the fourth sorting run the desired order is produced in the "parking sections B.1, B.2".

A sorting system and a sorting method are described in EP 1878511 A1 in order to sort a number of postal items in two phases of a single sorting run. In the exemplary embodiment each postal item hangs on a clamping arrangement ("clamp") and is transported on this clamping arrangement through the entire sorting system. In the first phase, at least one "batch sorting model 100" divides the incoming postal items into "batches"; see FIG. 1. Each "batch" consists of all postal items of which the delivery addresses belong to the same group. In the second phase, at least one "address sorting module 200" sorts the "batches" in succession, wherein the "address sorting module 200" brings all postal items within a "batch" into an order; see FIG. 2. An "unsorted mail input path 105" transports the postal items not yet sorted past a sequence of, for example, three storage devices 112, specifically the "batch storage 1", the "batch storage 2", and the "batch storage 3"; see FIG. 1. A "diverter subsystem 110" leads from the path 105 to each of the storage devices 112. The "diverter subsystems 110" distribute the postal items between the storage devices 112. An "output 114" leads from each storage device 112 to a "third path/exit transport 111". The "address sorting module 200" receives the postal items within a "batch" by means of the path 111. A path 205 leads the postal items past a sequence of, for example, "fourteen address stations 215". A "diverter subsystem 210" leads to each "address station 215". FIG. 3a shows an arrangement 300 comprising a plurality of "batch sorting modules" and a plurality of "address sorting modules 200", which are all connected in series.

U.S. Pat. No. 7,080,739 B2 describes a sorting system for flat postal items ("postal sorting machine 1") with two rows arranged one above the other of storage devices ("sort outlets 7"). The upper row 6b is shifted ("offset") with respect to the lower row 6a. A conveying arrangement ("transfer structure 3") having two conveying belts ("conveyors 9") arranged one above the other is located opposite the two rows 6a, 6b. The sorting system 1 runs through two sorting runs ("2-pass sequencing") in order to sort postal items accurately according to route ("delivery round"). In the first sorting run, the postal items are distributed between the storage devices 7, where they are brought into containers 4. A reloading arrangement ("gangway 10") brings the filled containers 4 from the storage devices 7 to the conveying belts 9.

A "paper sheet handling apparatus" is described in EP 0575032 A2. The "mail handling apparatus 1" of FIG. 1 has a "supply section 3", a "feeding section 4", a "transfer section 5", a "reading section 6", a plurality of "sorting gates 7a, 7b . . . , 7n", and a plurality of "regulating box groups 8a, 8b . . . , 8n". Postal items are distributed according to their delivery addresses between the "regulating box groups 8a, 8b, . . . , 8n". A plurality of "collecting sections 9a, 9b, . . . , 9n" collect those postal items that are output ("discharged") from the "box groups 8a, 8b, . . . , 8n". In addition, "overflow-item collecting sections 26a, 26b, . . . , 26n" receive excess postal items from the "boxes 8a, . . . , 8n". A "sorting gate 7r" discharges postal items into a "rejected-item collecting section 9r". If the "sorting gate 7a" has discharged a postal item into the "box group 8a", this postal item thus reaches a "sub-transfer passage 5a" and is transported past a sequence of "delivery gates 22a, 22b, . . . , 22h". Each "delivery gate 22a, 22b, . . . , 22n" leads to a "regulating box 23a, 23b, . . . , 23n". Each such "box 23a, 23b, . . . , 23n" is emptied by a "discharge member 24a, 24b, . . . , 24n" into the "collecting section 9a".

WO 01/12347 A1 describes a sorting system and a sorting method. In the example of FIG. 1, six objects are to be sorted, wherein the order numbers of the objects are initially arranged in the order 5, 4, 7, 2, 1, 3, and the objects are fed in the corresponding sequence via a feed conveying path Z. Each object is transported on its own conveying support. Each order number has a binary representation, for example 5 has the binary representation 101. A first diverter point W1 distributes the objects according to the last bit of the binary representation between two storage areas 21 and 22, such that all objects with an odd order number reach the storage area 22 and the remaining objects reach the storage area 21. A diverter point W21 downstream of the output of the storage area 21 distributes the objects according to the penultimate bit of the binary representation of the order numbers between two successive storage paths 31 and 32. A diverter W22 downstream of the output of the storage area 22 distributes the objects likewise according to the penultimate bit between the two successive storage paths 31 and 32. This is continued until the objects reach the storage area 51 in the desired order. FIG. 2 shows an arrangement which performs this method and makes it possible to sort 16 objects. The diverter point WO divides the objects according to the highest bit between two preparation storage devices SPO1, SPO2. The objects having the order numbers 1 to 7 thus reach the storage device SPO1. The storage device SPO1 is initially emptied, and the objects are fed from SPO1 to the conveying circuit 50. A diverter point W steers an object according to the last bit of the order number either into an inner bridging branch 50i or into an outer portion 50a of the conveying circuit 50. The objects then pass through further conveying circuits of identical structure and arranged in series downstream.

A sorting system is described in DE 10 2008 012 027 A1. This sorting system has a pocket conveying path with a number of storage pockets, and an output conveying path with a number of output containers. Two loading arrangements B1, B2 allow each of the storage pockets to be filled with at least one object. Each output container receives at least one object. Two unloading arrangements E1, E2 make it possible to remove an object from an output container. Each object is fed by a loading arrangement B1, B2 into a storage pocket and is transported in the storage pocket until the storage pocket has reached a transfer region Ü. The object then passes from the storage pocket into an output container. In an input-optimized mode of the sorting system, both loading arrangements B1, B2 and an unloading arrangement E1 are activated. In an output-optimized mode, a loading arrangement B1 and both unloading arrangements E1, E2 are activated. This sorting system can be used, for example, to sort flat postal items.

BRIEF SUMMARY OF THE INVENTION

The object of the invention is to provide a flexible sorting system and a flexible sorting method which sort a number of objects by means of a number of selectable storage devices according to a predetermined sorting feature and which enable a rapid emptying of at least some of the selectable storage devices.

The object is achieved by a sorting system as claimed and described. Advantageous embodiments are specified in the dependent claims.

The sorting system according to the solution and the sorting method according to the solution make to possible to sort a number of objects according to a predetermined sorting feature. The sorting feature takes on a value for each object to be sorted. It is possible for the sorting feature to take on the same vale for various objects to be sorted.

A sorting system having a first storage area and a second storage area is used. The first storage area is spatially separate from the second storage area. Each storage area comprises a number of storage devices. Each storage device can receive a number of objects to be sorted. Each storage device is delimited from the other storage devices within the same storage area. The sorting of the objects comprises the step that the sorting system divides the objects to be sorted between these storage devices according to the sorting feature values of said objects.

The following steps are carried out for each object to be sorted:

- A measuring apparatus measures which value the predetermined sorting feature takes on for this object.
- A selecting unit automatically selects a storage device for this object according to the measured sorting feature value.
- The object is transported to this selected storage device and is discharged into said storage device.

Each storage device is subsequently emptied, wherein the objects are transported away from the storage device or are removed from the storage device in a different way.

At least one selectable storage device of the first storage area comprises a store output and an emptying transport path. This emptying transport path connects this store output to at least one storage device of the second storage area. An object to be sorted can be transported from this storage device of the first storage area via the store output and the emptying transport path of this storage device into the storage device of the second storage area.

At least one selectable storage device of the first storage area having a store output is emptied completely or at least in part in that objects are transported from this storage device via the store output and the emptying transport path into a storage device of the second storage area.

In accordance with the solution the sorting system is operated selectively in a sorting destination-optimized mode or in an emptying-optimized mode. In the sorting destination-optimized mode, the objects are divided according to the measured sorting feature values between the storage devices of both storage areas. In the sorting destination-optimized mode, both storage areas are thus available to be selected and to receive objects. It is of course possible that individual or even all storage devices of the first and/or of the second storage area also are not selected during operation in the sorting destination-optimized mode, and therefore do not receive any objects to be sorted.

By contrast, in the emptying-optimized mode, those storage devices of the first storage area having a store output and an emptying transport path are selected exclusively, but no storage devices of the second storage area and no storage devices without a store output. Each selectable storage device of the first storage area having a store output is then emptied via its emptying transport path in that the objects are transported into a storage device of the second storage area. In the emptying-optimized mode, the sorting system is configured to quickly empty the storage devices of the first storage area with use of the store outputs.

The invention spares the need for all storage devices of the first storage area to be accessible from the outside in order to remove objects there from. Furthermore, it is not necessary for all storage devices of the first storage area to lead into the same emptying transport path in order to empty the storage devices of the first storage area.

Thanks to the invention, each storage device of the first storage area having a store output can instead be emptied into a storage device of the second storage area. Various storage devices of the first storage area can be emptied into different storage devices of the second storage area, such that a mixing of objects is avoided. Thanks to the invention, space is thus saved, which would otherwise be necessary to provide an emptying transport path or to access the storage devices from the outside. It is of course possible for individual or even all storage devices to be accessible from the outside. In this case, a storage device having a store output can be emptied both via the emptying transport path according to the solution and from the outside. It is also possible for a removing conveying arrangement with a continuous emptying transport path to be provided in order to empty the storage devices of the first storage area. Both options can be implemented thanks to the invention, but are not necessary.

Because the sorting system can be operated selectively in the sorting destination-optimized mode or in the emptying-optimized mode, a particularly flexible sorting system is provided. This advantage is achieved in particular in that at least one selectable storage device of the first storage area has a store output and an emptying transport path, preferably a plurality of storage devices or even all storage devices of the first storage area. This storage device with the emptying transport path can be emptied selectively from the outside or in that all or at least some objects in this storage device are transported in accordance with the solution via the associated store output and the associated emptying transport path to a storage device of the second storage area. This makes it possible to use the same sorting system according to the solution selectively in a first operating mode, in which this storage device of the first storage area is emptied from the outside or by means of a continuous transport path for a number of storage devices or even all storage devices of the first storage area, and in a second operating mode, in which this storage device is emptied into the storage device of the second storage area. Furthermore, this storage device can be quickly emptied by means of the store output and the emptying transport path, even if the storage device is poorly accessible from the outside. In the emptying-optimized mode the objects to be sorted are divided exclusively between the selectable storage devices of the first storage area. Whilst the storage devices of the first storage area are filled with these objects, the storage devices of the second storage area are still available for a prior sorting task and can be emptied for example whilst the storage devices of the first storage area are filled. The steps of filling the storage devices of the first storage area during the current sorting task and of emptying the storage devices of the second storage area during the prior sorting task may be performed with temporal overlap, which saves time.

The embodiment according to the solution with the two modes makes it possible to use the same sorting system for the following two sorting tasks:

- for a sorting task in which there are at most as many different sorting feature values as the total number of selectable storage devices comprised by the two storage areas, as a result of which the sorting system is operated in the sorting destination-optimized mode and the objects are sorted in a single sorting run, and
- for a sorting task in which there are considerably more different sorting feature values than the number of storage devices comprised by the sorting system, as a result of which a number of sorting runs are carried out in succession ("n-pass sequencing") and the sorting system is operated in the emptying-optimized mode so as to be able to empty the storage devices quickly, such that they are then available for a subsequent sorting run or a subsequent sorting task.

The same sorting system according to the solution can thus be used successively in two modes for two different sorting tasks. This is more economical and saves space ("footprint") compared with an arrangement having two different sorting systems for the two sorting tasks. The sorting system can preferably switch over from the sorting destination-optimized mode into the emptying-optimized mode and vice versa from the emptying-optimized mode into the sorting destination-optimized mode in that the machine control is changed, without performing a mechanical alteration.

In particular with operation in the emptying-optimized mode, it is not necessary to have to access from the outside a storage device of the first storage area having a store output in order to unload the storage device. Rather, the storage devices having store outputs are preferably unloaded automatically in that the objects are transported from these storage devices into at least one storage device of the second storage area. This embodiment makes it possible to install the storage devices of the second storage area at optimum access height and in an optimum access position for an authorized user or automated handling system, whereas the first storage area and therefore the storage devices having the store outputs do not have to be so accessible.

In the emptying-optimized mode, a storage device of the first storage area is preferably then emptied as soon as all objects for which the selecting unit has selected this storage device have been transported into this storage device and it is certain that the selecting unit will not select this storage device for any further object to be sorted. This storage device of the first storage area is thus emptied as quickly as possible and is available for further objects which are to be sorted in another sorting process.

With operation in the emptying-optimized mode, a storage device of the first storage area is preferably emptied completely in that all objects are transported via the store output and the emptying transport path into a storage device of the second storage area. The emptying is preferably triggered by the event that all objects for which this storage device of the first storage area was selected have reached this storage device, such that no further objects are to be transported into this storage device of the first storage area. Due to this embodiment the emptied storage device is available as early as possible for a subsequent sorting task, even if the current sorting task is not yet complete.

In an embodiment at least the storage devices of the second storage area are accessible from the outside. In the sorting destination-optimized mode these storage devices are emptied from the outside. In a development of this embodiment the storage devices of the first storage area are also accessible from the outside. In the sorting destination-optimized mode all storage devices are then emptied from the outside. By contrast, in the emptying-optimized mode, all storage devices of the first storage area are emptied by means of the store outputs. In an embodiment the step of emptying a storage device from the outside comprises the step of bringing those objects that have been discharged into this storage device into a container or into a vehicle and of transporting away this container or this vehicle together with the objects.

In an embodiment a removing conveying arrangement transports away those objects which were previously discharged into a storage device of the second storage area. In the emptying-optimized mode these storage devices of the second storage area were previously filled in that the objects from the storage devices of the first storage area were brought by means of the store outputs and the emptying transport paths into the storage devices of the second storage area. In the sorting destination-optimized mode the selecting unit has selected storage devices of the second storage area for some objects, and the objects are transported and discharged directly into the selected storage device. The use of a removing conveying arrangement saves the need to empty a storage device from the outside. In a development of this embodiment each storage device of the second storage area forms a portion of this removing conveying arrangement. The selecting unit therefore selects a portion of the removing conveying arrangement during the sorting process. Objects are discharged into a storage device of the second storage area in that these objects are brought to or into the corresponding selected portion of the removing conveying arrangement. As a result of this development, transport from a storage device of the second storage area to the removing conveying arrangement is saved. An order of the objects in or to or on the removing conveying arrangement is already produced during the sorting process.

The embodiment with the portions of the removing conveying arrangement as storage devices of the second storage area allows the following approach: the removing conveying arrangement makes it possible to transport objects in a conveying direction. If a portion of the removing conveying arrangement is filled, all objects downstream of this filled portion are thus transported forwards. In an embodiment the objects in the filled portion are additionally transported forwards. A portion is thus free downstream or also upstream of the filled portion.

The selecting unit, in the sorting destination-optimized mode, uses an amended sorting scheme, for example an amended sorting plan, and discharges objects into the cleared portion instead of into the filled portion. In the emptying-optimized mode, a storage device of the first storage area can be emptied into the cleared portion. The sequence of objects in the removing conveying arrangement can thus further correspond to a predetermined order of sorting feature values, without the filled portion causing an interruption. A storage and transport component is preferably located between at least one emptying transport path, which connects a storage device of the first storage area to a storage device of the second storage area, and one storage device of the second storage area.

In particular if the sorting system is operated in the emptying-optimized mode, this storage and transport component is then used as a physical storage device extension of the storage device of the second storage area. Objects from the storage device of the first storage area can be storage deviced via the emptying transport path both in the storage device of the second storage area and in the storage and transport component, such that more space is available. The storage and transport component therefore functions in particular in the emptying-optimized mode as a storage device extension of the subsequent storage device of the second storage area. This extension of the storage device is implemented without having to modify the sorting system mechanically or manually during running operation.

Once objects have been brought directly (after selection) or via a storage device of the first storage area into a storage device of the second storage area, the storage and transport component is used as part of a removing conveying arrangement having a continuous transport path in order to empty at least one storage device of the second storage area. The storage and transport component forms a portion of this transport path. Objects from this storage device of the second storage area are transported through the storage and transport component. In this mode the storage and transport component functions as part of a transport arrangement for emptying the second storage area.

The embodiment with the storage and transport component thus leads to a sorting system that is even more flexible. In an embodiment at least one storage device of the sorting system has an input, a store output according to the solution, and a storage device transport path which leads from the input to the store output. The storage device is operated in the first in/first out (FIFO) mode. An object is transported through the input into the storage device, is conveyed through the storage device during the storage process, and is later transported out from the storage device through the store output. This embodiment enables a particularly simple mechanical structure of the storage device. The spatial requirement is lower than with other storage devices, and the control is simpler. A reversal of direction is not necessary.

In a development each storage device operates in the FIFO mode. The sorting system additionally has a plurality of retaining devices. Each object is brought into a retaining device or is temporarily connected to the retaining device in another way. This preferably occurs once the value which the sorting feature takes on for this object has been measured. The object is transported in or on the retaining device to the selected storage device and is transported through the input into the selected storage device. Here, the object remains in the or on the retaining device. The object in or on the retaining device is transported out from the storage device through the store output, without separating the object from the retaining device. The retaining device for example comprises a pocket, at least one clamp or one hook.

In an embodiment the first storage area comprises a first continuous transport path having a plurality of lead-in points. This first continuous transport path preferably further comprises branch points, for example each with a diverter point. Each storage device of the first storage area is a portion of this continuous transport path, in which neither a lead-in point nor a branch point is present. The second storage area comprises a second continuous transport path having a number of lead-in points. Each storage device of the second storage area is a portion of this second continuous transport path in which no lead-in points are present. An object is brought into a storage device in that the object is discharged into the continuous transport path by means of the lead-in point directly upstream of the storage device. All storage devices thus operate in the FIFO mode. This embodiment enables a particularly simple implementation.

In an embodiment the sorting system comprises a discharge transport path, which transports the objects to be sorted to the two storage areas. Furthermore, an issuing transport path leads to each selectable storage device of the sorting system. Each issuing transport path starts at an output of a forwarding diverter point and ends at the storage device. Each forwarding diverter point has at least two outputs and makes it possible to selectively steer an object to be sorted into the one output or into the other output. An issuing transport path to a storage device of the first storage area starts at the one output. At the other output of the diverter point, an issuing transport path starts to a storage device of the second storage area. A connection transport path leads to the input of this forwarding diverter point. This connection transport path preferably starts at a discharge diverter point, which can discharge objects from the discharge transport path.

This embodiment saves transport paths, in particular because the connection transport path can be used both for the first storage area and for the second storage area. This embodiment can be combined in a space-saving manner with an embodiment in which the first storage area lies in a first plane and the second storage area lies in a second plane. The second plane is preferably located below the first plane. The first plane can be located above the reaching height of an authorized adult user. This embodiment further leads to particularly short transport routes for the transport of objects. An object is transported to the connection transport path and is transported to the selected storage device via this connection transport path and via the issuing transport path of said storage device. The connection transport paths and the issuing transport paths can be formed as short paths. Each connection transport path leads to at least one storage device of the first storage area and to at least one storage device of the second storage area. At most, only half as many connection transport paths as selectable storage devices are therefore required. It is not necessary to provide a direct connection to a selectable storage device.

All of these connection transport paths are preferably fed by a single discharge transport path. This one discharge transport path only needs to be as long as the longest dimension of a storage area, but nevertheless can feed both storage areas.

The embodiment with the connection transport paths and the issuing transport paths makes it possible to provide a sorting system without an overtake point, without a return section and without another mechanism which would make it possible to change the order of objects to be sorted. The continuous discharge transport path can also be produced without such a mechanism.

In an embodiment the first storage area is arranged in an upper plane, and the second storage area is arranged in a lower plane. The or each emptying transport path leads from the upper plane into the lower plane. It is also possible for the first storage area and the second storage area to be arranged in one plane, more specifically "back to back". In an embodiment those storage devices of the first storage area having a store output and an emptying transport path are emptied in pairs into various storage devices of the second storage area. Each emptying transport path thus leads to another storage device of the second storage area. Each storage device of the first storage area can thus be emptied independently of any other storage device of the first storage area.

In another embodiment two emptying transport paths lead to the same storage device of the second storage area. By way of example, a Y-arrangement is provided which starts at the two store outputs of these two storage devices of the first storage area and leads to this one storage device of the second storage area. This embodiment saves storage devices of the second storage area, since the two storage devices of the first storage area can be emptied into the same storage device of the second storage area until this storage device of the second storage area is completely filled.

In an embodiment the sorting system comprises at least one further storage device or another issuing unit for objects. An object to be sorted then reaches this issuing unit if the measuring apparatus could not measure the sorting feature value of this object or could not measure it within a predetermined period of time. An object to be sorted then preferably also reaches this issuing unit if there is no selectable storage device available, for example because the storage device that is intended for the sorting feature value of this object is full or defective.

In an embodiment the sorting feature is a physical parameter, for example a dimension, the volume, the weight, a surface finish or a color. In a further embodiment a number of object types are predetermined, and each object type acts as a possible sorting feature value. In a further embodiment each object is provided with a marking of a destination point, to which this object is to be transported. Each distribution point marking acts as a sorting feature value.

In an embodiment each object is provided with a unique machine-readable identifier, for example with an ID code. A dataset is storage deviced for each object in a database and comprises this identifier and also the measured or predetermined value which the predetermined sorting feature takes on for this object. The sorting system reads the identifier on the object and directs a query with this identifier to the database. The response delivers the sorting feature value.

The invention will be described hereinafter on the basis of an exemplary embodiment. In the figures:

DESCRIPTION OF THE INVENTION

Figure 1:
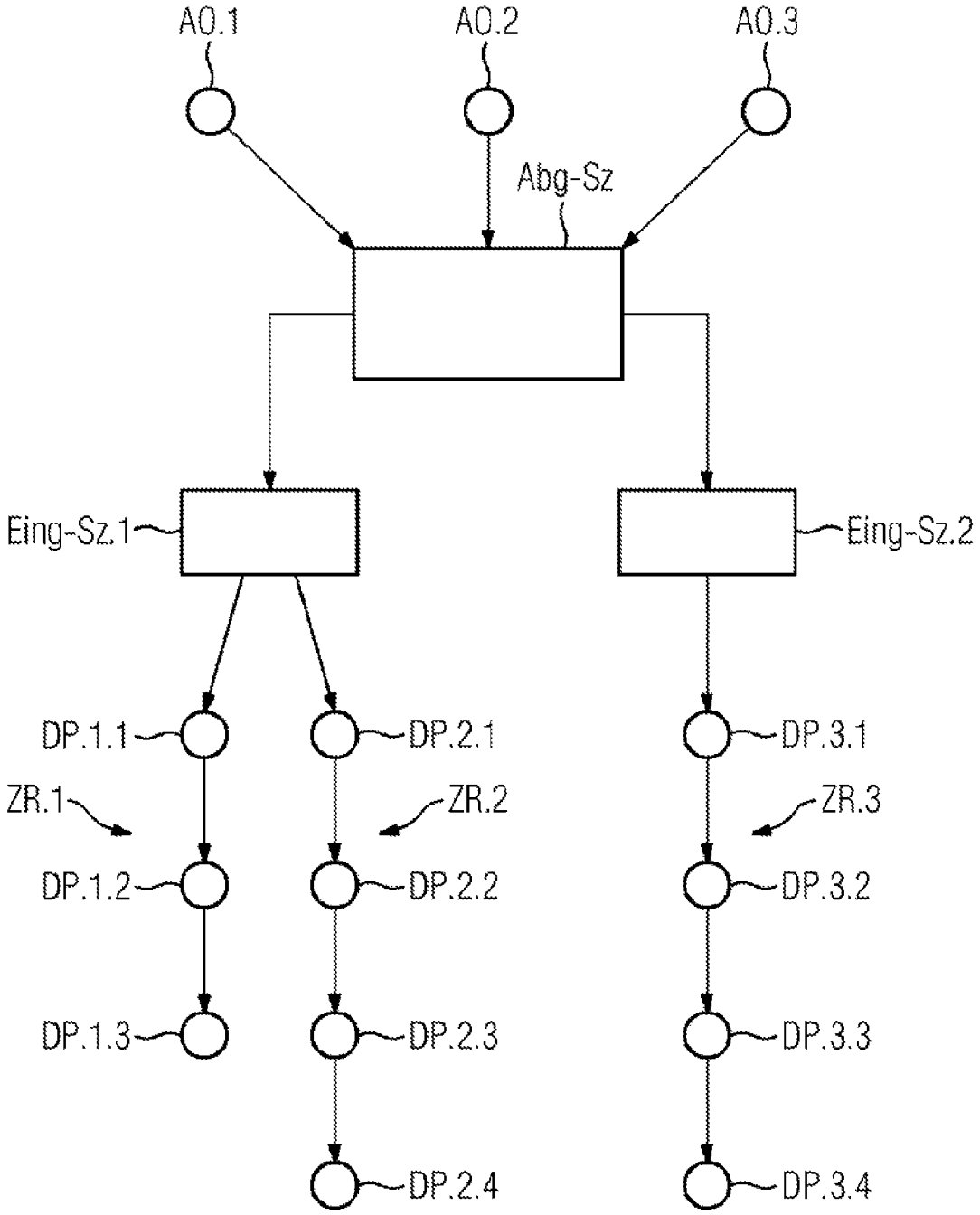
FIG. 1 shows a logistics network comprising three sorting centers for postal items.

In the exemplary embodiment the sorting system according to the solution is used for sorting flat postal items (standard letters, large letters, postcards, magazines, and the like). For each postal item, the destination point (receiver and postal address or geocoordinates) to which this postal item is to be transported is predetermined. Either the postal item is provided with a marking of this destination point, or a computer-analyzable list containing destination points is transmitted to a data processing system and unaddressed and similar postal items are transported to the sorting system according to the solution. The sorting system then assigns each unaddressed similar postal item with a destination point from the destination point list. Otherwise, the postal item is provided with a unique machine-readable identifier, and a coding of the destination point is storage deviced together with this unique identifier in a database.

Each postal item in the exemplary embodiment passes through a sorting system at least twice on its way from the point of admission to the predetermined destination point. An exception is possible for postal items to a receiver of many postal items and for postal items that cannot be handled by a machine. The postal item is generally subjected to a leaving sorting process as it passes for the first time through a sorting system and to an entering sorting process as it passes for a second time through a sorting system. It is possible for a postal item to pass through the same sorting system twice in succession, specifically the first time with a leaving sorting process and the second time with an entering sorting process.

Each sorting system is responsible for an area of responsibility. In the case of the leaving sorting process, a sorting system divides all postal items which have been admitted in the area of responsibility of this sorting system between the areas of responsibility of the destination locations. With N areas of responsibility, the sorting system during the leaving sorting process thus sorts between N different sorting destinations (sorting directions). The postal items for the same area of responsibility are transported jointly to the sorting system for this area of responsibility.

The sorting system for the area of responsibility sorts the incoming postal items more accurately in the subsequent entering sorting process, for example in accordance with regions of responsibility of the area of responsibility or even between delivery routes of the delivery staff (carriers, postmen). In the exemplary embodiment a hierarchical sorting (tree sort) is performed during the entering sorting process, in which the quantity of incoming postal items is divided in a first step into sub-quantities, and each sub-quantity is further divided and/or is sorted in a subsequent second step. By way of example, for each delivery route, a delivery sequence of the delivery points of this delivery route is predetermined, and the postal items for this delivery route are sorted in accordance with this delivery route.

The same sorting system according to the solution is used in succession in the exemplary embodiment for the leaving sorting process and then for the entering sorting process. In the leaving sorting process, the sorting system is operated in a sorting destination-optimized mode so as to have available as many selectable storage devices as possible for different sorting destinations (areas of responsibility of sorting systems). In the leaving sorting process, at least as many storage devices of the sorting system as there are different sorting destinations are available for sorting the outgoing postal items. In the entering sorting process, the sorting system is operated in an emptying-optimized mode so as to empty the storage devices as quickly as possible once a sub-quantity of postal items have been processed, so as to be able to quickly process a further sub-quantity. During the entering sorting process, fewer storage devices than the number of different sorting destinations are available for sorting the incoming postal items.

FIG. 1 by way of example shows a logistics network for transporting postal items. Postal items from the three shown sender locations AO.1, AO.2, AO.3 are transported to the same leaving sorting center Abg-Sz. A first sorting system according to the solution performs the leaving sorting process in the leaving sorting center Abg-Sz and is operated in this case in the sorting destination-optimized mode. This first sorting system divides the incoming postal items between entry sorting centers, including between the two illustrated entry sorting centers Eing-Sz.1 and Eing-Sz.2. The postal items intended for an area of responsibility are transported to this sorting system.

In each of the two entry sorting centers Eing-Sz.1 and Eing-Sz.2, a sorting system according to the solution performs an entering sorting process and is operated in this case in the emptying-optimized mode. The sorting system, in the entry sorting center Eing-Sz.1, performs inter alia a delivery route sorting process for the two delivery routes ZR.1 and ZR.2 with the delivery points DP.1.1, DP.1.2, . . . and DP2.1. DP2.2, . . . respectively. The sorting system, in the entry sorting center Eing-Sz.2, performs inter alia a delivery route sorting process for the delivery route ZR.3 with the delivery points DP.3.1, DP.3.2, . . . .

Figure 2:
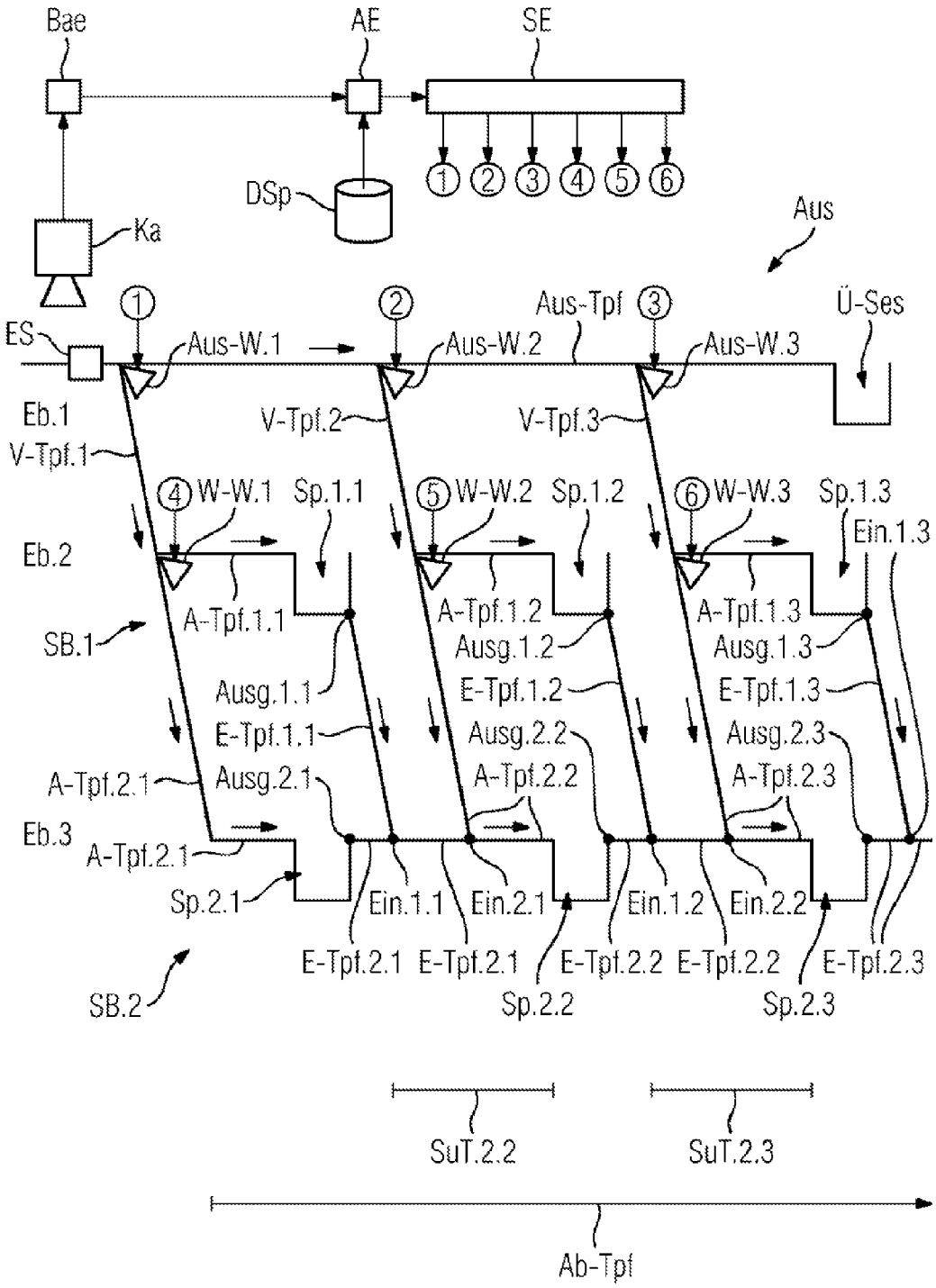
FIG. 2 schematically shows a number of components of the sorting system according to the solution, including three storage devices of the first storage area and three storage devices of the second storage area.

FIG. 2 schematically shows a number of components of the sorting system according to the solution. The following are shown:

- a camera Ka, which makes it possible to generate computer-analyzable images of postal items which are transported past the camera Ka in an upright position,
- a data-processing image evaluation unit Bae, which makes it possible to evaluate the images from the camera Ka in order to decipher destination point markings or identifiers in images of postal items,
- a data storage device Dsp, in which at least one computer-analyzable sorting plan is storage deviced per sorting task,
- a selecting unit AE, which automatically selects a storage device for each postal item, depending on the deciphered destination point marking,
- a control unit SE, which receives signals from the selecting unit AE and from further components of the sorting system, and, inter alia, controls the diverter points of the sorting system and the drives of the transport paths,
- a discharge transport path Aus-Tpf having a plurality of discharge diverter points Aus-W.1, Aus-W.2, . . . arranged in a sequence,
- a feeding station ES, which brings postal items into retaining devices and which introduces the retaining devices of the postal items into the discharge transport path Aus-Tpf,
- an overflow storage device Ü-Sp at the end of the discharge transport path Aus-Tpf,
- a first storage area SB.1 and
- a second storage area SB.2.

The first storage area SB.1 comprises a sequence Sp.1.1, Sp.1.2, . . . of storage devices. The second storage area SB.2 comprises a sequence Sp.2.1, Sp2.2, . . . of storage devices. Each storage device can receive a number of retaining devices with flat postal items. In an embodiment all storage devices are embodied identically.

In another embodiment a distinction is made between a number of types of postal items to be sorted, and there is a type of selectable storage device for each postal item type. In this embodiment the type of postal items to be sorted is determined, and a suitable storage device is selected, more specifically according to the determined destination point and the determined postal item type. In the exemplary embodiment the sorting system comprises three planes Eb.1, Eb.2, Eb.3 arranged one above the other, wherein Eb.1 is the upper plane, Eb.2 is the middle plane, and Eb.3 is the lower plane. FIG. 1 is a schematic side view.

The following are located in the upper plane Eb.1

- the feeding station ES,
- the discharge transport path Aus-Tpf with the discharge diverter points Aus-W.1, Aus-W.2, . . . and
- the overflow storage device Ü-Sp.

The following are located in the middle plane Eb.2

- the storage devices Sp.1.1, Sp.1.2, . . . of the first storage area SB.1, and
- the forwarding diverter points W-W.1, W-W.2, . . . .

The storage devices Sp.2.1, Sp2.2, . . . of the second storage area SB.2 are located in the lower plane Eb.3

The embodiment with the planes arranged one above the other saves floor area (footprint).

A computer-analyzable sorting plan is storage deviced in the data storage device DSp for each sorting run of a sorting task. If a sorting run is performed during the leaving sorting process and a total of n sorting runs are performed during the entering sorting process and subsequent sequence sorting process, n+1 sorting plans are thus storage deviced in the data storage device DSp on the same sorting system according to the solution. Precisely one sorting plan is currently activated, apart from if the sorting system is not currently being used due to servicing or the like.

The data-processing selecting unit AE makes it possible to automatically select a storage device Sp.1.1, Sp.2.1, . . . for each postal item. For selection, the selecting unit AE uses the sorting plan storage deviced in the data storage device DSp and currently activated for the destination point marking deciphered by the image evaluation unit Bae. Each sorting plan assigns each occurring destination point marking to a storage device. The selecting unit AE selects this assigned storage device automatically. It is possible for different storage deviced sorting plans to be used for a number of successive sorting tasks or sorting runs and for one sorting plan to be activated in each case. The selecting unit AE generally selects the same storage device for a number of different postal items having different destination points, because the number of postal items to be sorted is significantly greater than the number of different storage devices comprised by the sorting system.

The control unit SE receives a signal from the selecting unit AE for each postal item, said signal indicating the storage device selected by the selecting unit AE for this postal item. A reference position of the postal item is measured at a starting moment, for example in that a light barrier determines when the front edge of the postal item interrupts the light beam of this light barrier. The transport speed at which this postal item is transported is also measured or predetermined. The control unit SE controls the discharge diverter points Aus-W.1, Aus-W.2, . . . and the forwarding diverter points W-W.1, W-W.2, . . . , such that the postal item is transported into the selected storage device.

Each storage device Sp.1.1, . . . , Sp.2.1, . . . in the exemplary embodiment has a store output Ausg.1.1, . . . , Ausg.1.2, . . . . The store output Ausg.m.n belongs to the storage device Sp.m.n (m=1, 2; n=1, 2, . . . ) of the storage area SB.m. An emptying transport path E-Tpf.1.1, . . . , E-Tpf.2.1, . . . starts at each store output Ausg.1.1, . . . , Ausg.1.2, . . . . A storage device Sp.1.1, . . . , Sp.2.1, . . . can be emptied via the associated store output Ausg.1.1, . . . , Ausg.1.2, . . . and the associated emptying transport path E-Tpf.1.1, . . . , E-Tpf.2.1, . . . in that the postal items are transported from the storage device through the store output and are transported away from the emptying transport path and are transported to a storage device of the second storage area SB.2. An output transport path A-Tpf.1.1, . . . , A-Tpf.2.1, . . . leads to each storage device Sp.1.1, . . . , Sp.2.1, . . . . The output transport path A-Tpf.m.n leads to the storage device Sp.m.n, and the emptying transport path E-Tpf.m.n of the storage device Sp.m.n starts at the store output Ausg.m.n (m=1, 2; n=1, 2, . . . ).

Each output transport path A-Tpf.1.1, . . . , A-Tpf.2.1, . . . starts at an output of a forwarding diverter point W-W.1, W-W.2, . . . . The output transport path A-Tpf.1.*n* to the storage device Sp.1.*n* of the first storage area Sp.1 starts at one output of the forwarding diverter point W-W.n, and the output transport path A-Tpf.2.*n* (n=1, 2, . . . ) to the storage device Sp.2 of the second storage area Sp.2 starts at the other output. The output transport paths A-Tpf.1.1, A-Tpf.1.2, . . . to the storage devices Sp.1.1, Sp.1.2, . . . of the first storage area SB.1 are located in the middle plane Eb.2. The output transport paths A-Tpf.2.1, A-Tpf.2.2, . . . to the storage devices Sp.2.1, Sp.2.2, . . . of the second storage area SB.2 have a portion which leads away from the middle plane Eb.2 to the lower plane Eb.3, and in an embodiment have a subsequent portion in each case in the lower plane Eb.3.

The connection transport path V-Tpf.n (n=1, 2, . . . ) leads to the input of the forwarding diverter point W-W.n. This connection transport path V-Tpf.n starts at an output of the discharge diverter point Aus-W.n. The discharge diverter points Aus-W.1, Aus-W.2, . . . are arranged in succession in the discharge transport path Aus-Tpf.

In the exemplary embodiment each discharge diverter point Aus-W.1, Aus-W.2, . . . also has two outputs. A connection transport path V-Tpf.1, V-Tpf.2, . . . starts at one output, that is to say a postal item is discharged from the discharge transport path Aus-Tpf by means of this output. The other output leaves a postal item in the discharge transport path Aus-Tpf. The emptying transport paths E-Tpf.1.1, E-Tpf.1.2, . . . of the storage devices of the first storage area SB.1 differ from the emptying transport paths E-Tpf.2.1, E-Tpf.2.2, . . . of the storage devices of the second storage area SB.2 as follows: each emptying transport path E-Tpf.1.*n* of a storage device Sp.1.*n* of the first storage area SB.1 leads from the store output Ausg.1.*n* to a lead-in point Ein.1.*n*. This lead-in point Ein.1.*n* is arranged in the emptying transport path E-Tpf.2.*n* of the storage device Sp.2.*n*. This emptying transport path E-Tpf.2.*n* starts at the store output Ausg.2.*n* of the storage device Sp.2.*n* and leads at the lead-in point Ein.1.*n* into the output transport path A-Tpf.2.*n*+1.

This embodiment makes it possible to empty a storage device Sp.1.*n* of the first storage area SB.1 via the store output Ausg.1.*n*, the emptying transport path E-Tpf.1.*n*, the lead-in point Ein.1.*n*, the emptying transport path E-Tpf.2.*n*, the lead-in point Ein.2.*n* and the output transport path A-Tpf.2.*n*+1 into the storage device Sp.2.*n*+1 of the second storage area SB.2 (n=1, 2, . . . ).

The emptying transport paths E-Tpf.2.1, E-Tpf.1.2, . . . and a portion of the output transport paths A-Tpf.2.1, A-Tpf2.2, . . . arranged in the lower plane Eb.3 together form a continuous removing path Ab-Tpf, via which the storage devices Sp.2.1, Sp.2.2, . . . of the second storage area SB.2 can be emptied. The lead-in points Ein.1.1 . . . , Ein.1.2, . . . of the emptying transport paths E-Tpf.1.1, . . . , E-Tpf.2.1, . . . from the storage devices of the first storage area SB.1 and also the lead-in points Ein.2.1 . . . , Ein2.2, . . . of the emptying transport paths E-Tpf.2.1, E-Tpf.2.2, . . . from the storage devices of the second storage area SB.2 are arranged in this continuous removing path Ab-Tpf.

In the embodiment shown in FIG. 2, each output transport path A-Tpf.2.1, A-Tpf.2.2, . . . of the second storage area SB.2 has a horizontal portion in the lower plane Eb.3. In an alternative embodiment this horizontal portion is omitted, which leads to larger storage devices Sp.2.1, Sp.2.2, . . . of the second storage area SB.2. The storage device Sp.2.*n*+1 then starts already at the lead-in point Ein.2.*n* (n=1, 2, . . . ).

In the embodiment of FIG. 2 the emptying transport paths E-Tpf.1.1, E-Tpf.1.2, . . . of the storage devices of the first storage area SB.1 consist exclusively of a portion which is inclined in a diagonally sloping manner, runs from the middle plane Eb.2 to the lower plane Eb.3, and transports away postal items. In another embodiment a horizontal portion which transitions into the diagonally sloped portion starts at the store output Ausg.1.1, Ausg.1.2, . . . .

In the embodiment shown in FIG. 2, each path from the discharge transport path Aus-Tpf (in the upper plane Eb.1) leads to the continuous removing path Ab-Tpf (in the lower plane Eb.3) through at least one storage device Sp.2.1, Sp.2.2, . . . of the second storage area SB.2. In an alternative embodiment the sorting system additionally has a bypass. This bypass is likewise a transport path and starts at the discharge transport path after the last discharge diverter point Aus-Tpf, that is to say after the discharge diverter point Aus-W.3 in the example of FIG. 2. This bypass, after the last storage device of the second storage area and after the last lead-in point, leads into the continuous removing path Ab-Tpf. A postal item can be discharged directly from the discharge transport path Aus-Tpf into the continuous removing path Ab-Tpf via this bypass.

In an embodiment each postal item is transported in that the postal item is temporarily clamped between two opposed conveying belts. These conveying belts rotate at the same speed and transport the postal items, wherein the flat postal item is transported in a manner grasped permanently in a vertical position. The sorting system comprises what is known as a pinch belt system having a sequence in each case of two conveying belts arranged opposite one another and/or other complementary conveying elements, for example rolls. Each storage device of the sorting system receives a stack of upright postal items. The postal items in the stack overlap one another completely or also only in part. This stack grows with each further postal item stacked in a stack direction. A postal item is storage deviced temporarily in this storage device in that the postal item is added at an end of the stack and is thus stacked in. the postal item is removed again from the storage device in that the postal item is removed from the stack. Each storage device therefore has a singulator. The singulator can be arranged on the same side of the stack as the stacking point, or can be arranged on the opposite side. Depending on the arrangement of the singulator, the storage device operates either by the last in/first out (LIFO) principle or by the first in/first out (FIFO) principle.

It is also possible to use temporarily as a storage device a portion of the conveying arrangement comprising conveying belts by not rotating conveying belts temporarily. This portion of the conveying arrangement however is not available during this period for transporting postal items, as long as postal items are storage deviced temporarily therein.

In a preferred embodiment the sorting system by contrast has a plurality of holding devices (holders, escorts). Each holding device makes it possible to hold at least one flat postal item. The holding device is embodied for example as a pocket, into which a postal item can be inserted from the side or from above and later removed again from this pocket. It is also possible for the holding device to have a flap on the underside in order to release a postal item downwardly if the flap is opened. In another embodiment the holding device comprises a frame and a clip or two clips, which hold the postal item in the manner of a trouser hanger. The clips on the frame can open and close again.

Each holding device preferably receives just one postal item at any moment in time. The holding devices are reused, that is to say the same holding device receives various postal items in succession.

Each holding device is preferably provided with a unique machine-readable identifier. The information concerning which postal item has been brought into which holding device is storage deviced. Since the identifier of a holding device is read, it is possible to determine which postal item is currently located in which holding device. Since the location in the sorting system where a holding device with a specific identifier is currently located is determined, the current position of the postal item can be found.

Figure 3:
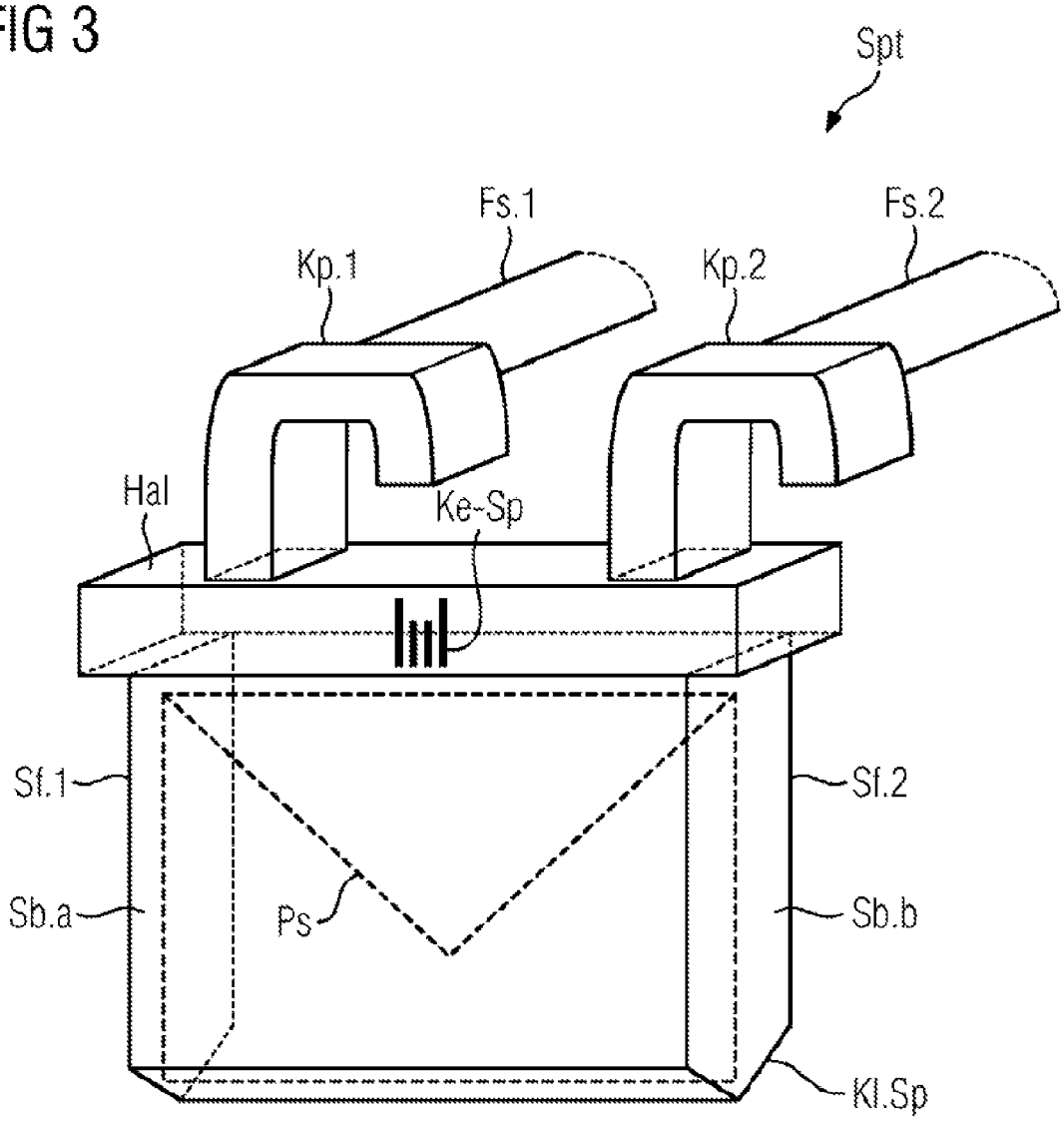
FIG. 3 shows a retaining device in the form of a pocket for a flat postal item.

FIG. 3 by way of example shows a holding device Spt in the form of a storage pocket for a flat postal item Ps. This holding device Spt comprises

- a mount Hal, to which a machine-readable identifier Ke-Sp is applied,
- two side faces Sf.1, Sf.2,
- two lateral defining planes SB.a, SB.b,
- a flap K1.Sp at the base of the storage pocket Spt, and
- two coupling elements Kp.1, Kp.2 on the mount Hal in the form of two clips.

The two coupling elements Kp.1, Kp.2 hang from two guide rails Fs.1, Fs.2, which are shown schematically and are arranged in parallel. In the shown embodiment a flat postal item Ps is inserted laterally through the defining plane SB.b into the space between the two side faces Sf.1, Sf.2, wherein the flap Kl.Sp is closed. The postal item then slides downwardly from the storage pocket Spt when the flap Kl-Sp is opened. The holding devices are transported by a suitable transport device. By way of example, the holding devices are drawn along a chain. In the exemplary embodiment the holding devices are embodied without their own drive and are therefore structured in a mechanically simple manner. A stationary central drive moves a transmission means, which moves the driveless holding devices.

Each holding device is transported such that the side faces Sf.1, Sf.2 and therefore the object plane of a flat postal item in the holding device Spt are arranged perpendicularly with respect to the direction of transport, in which the filled holding device is transported, such that only a small amount of space is required in the direction of transport. Both the discharge transport path Aus-Tpf and the forwarding transport paths, the issuing transport paths and the emptying transport paths make it possible to transport filled holding devices. In an embodiment a single holding device is used, such that all holding devices are similar, and each holding device can receive any postal item to be sorted.

Each storage device of the two storage areas SB.1, SB.2 can receive a number of holding devices. Each storage device SP.m.n preferably has an input, a store output Ausg.m.n, and a transport route from the input to the store output Ausg.m.n (m=1, 2; m=1, 2, . . . ). The storage device operates in accordance with the first in/first out (FIFO) principle. In an embodiment each storage device is a portion of a transport path. By way of example, the storage devices Sp.1.1, Sp.1.2, . . . of the first storage area SB.1 are portions of the issuing transport paths A-Tpf.1.1, A-Tpf.1.2, . . . , and the storage devices Sp.2.1, Sp.2.2, . . . of the second storage area SB.2 are portions of the continuous removing path Ab-Tpf.

In an embodiment a storage and transport component SuT.2.2, SuT.2.3, . . . is located before each of the storage devices Sp.2.2, SP.2.3, . . . of the second storage area SB.2. This storage and transport component SuT.2.*n* starts at the lead-in point Ein.1.*n* and ends at the input of the subsequent storage device Sp.n (n=1, 2, . . . ). Each storage and transport component SuT.2.2, SuT.2.3, . . . is used in the sorting destination-optimized mode as part of the issuing transport path A-Tpf.2.2, A-Tpf.2.3, . . . and as part of the removing path Ab-Tpf. In the emptying-optimized mode and in the "unload" state, the storage and transport component SuT.2.*n* is used as an extension of the subsequent downstream storage device Sp.2.*n* of the second storage area SB.2. Each storage and transport component SuT.2.2, SuT.2.3, . . . thus functions in the exemplary embodiment as a transport component in the sorting destination-optimized mode and as a storage device component in the emptying-optimized mode.

The path over which a postal item is transported to the selected storage device will be described hereinafter. A stack of postal items is transported to a singulator of the sorting system. The singulator separates the postal items. A stream of postal items distanced from one another is thus transported away from the singulator, such that the object planes of the separated postal items are upright. It is also possible for a number of singulators to work in parallel. By way of example, a first singulator processes a first type of postal items and a second singulator processes a second type of postal items. For example, the first type is constituted by standard letters, and the second type is constituted by the remaining flat postal items, in particular the large letters.

The camera Ka records a computer-analyzable image of the postal item. This image shows the destination point marking on the postal item. The image evaluation unit Bae deciphers this destination point marking by optical character recognition (OCR) or by video coding. The selecting unit AE uses the storage deviced and currently activated sorting plan and selects a currently selectable storage device Sp.m.n for this postal item according to the deciphered destination point marking. In the embodiment with the holding devices, the postal item is then brought into the holding device or is temporarily connected in another way to the holding device.

The postal item is fed by the feeding station ES into the discharge transport path Aus-Tpf and is transported to the selected storage device Sp.m.n (m=1, 2; n=1, 2, . . . ). In the embodiment with the holding devices, the feeding station ES brings postal items into holding devices and feeds these holding devices, which are filled with postal items, into the discharge transport path Aus-Tpf. Where possible, a number of feeding stations operate in parallel and feed postal items or filled holding devices in parallel.

The case m=1 will be described first, that is to say the case in which the selecting unit AE has selected a storage device Sp.1.*n* of the first storage area SB.1 for a postal item. The discharge transport path Auf-Tpf transports the postal item as far as the discharge diverter point Aus-W.n. The discharge diverter point Aus-W.n discharges the postal item from the discharge transport path Aus-Tpf into the connection transport path V-Tpf.n. The connection transport path V-Tpf.n transports the postal item to the forwarding diverter point W-W.n. The forwarding diverter point W-W.n diverts the postal item into the issuing transport path A-Tpf.1.*n*. The issuing transport path A-Tpf.1.*n* transports the postal item to the selected storage device Sp.1.*n*. The postal item is initially located in the upper plane Eb.1. The connection transport path V-Tpf.n guides the postal item into the middle plane Eb.2, in which the selected storage device Sp.1.*n* is also located.

This procedure is performed by the sorting system both in the sorting destination-optimized mode and in the emptying-optimized mode, that is to say both during the leaving sorting process and during the entering sorting process, once a storage device Sp.1.*n* of the first storage area SB.1 has been selected. The sorting system, as just described, is operated during the leaving sorting process in the sorting destination-optimized mode and during the entering sorting process in the emptying-optimized mode. In addition, the sorting system operates selectively in the "fill" state or in the "empty" state. Because both modes can be combined with both states, the same sorting system passes successively through 2×2=4 operating states.

In both modes the sorting system initially operates in the "load" state and loads the storage devices which are available in this sorting process for a selection by the selecting unit AE with postal items in holding devices. The way in which the sorting system fills the storage devices has just been described. To fill the storage devices, that is to say with operation in the "fill" state, the emptying transport paths E-Tpf.1.1, . . . , E-Tpf.2.1, . . . likewise are not required and are therefore deactivated.

Figure 4:
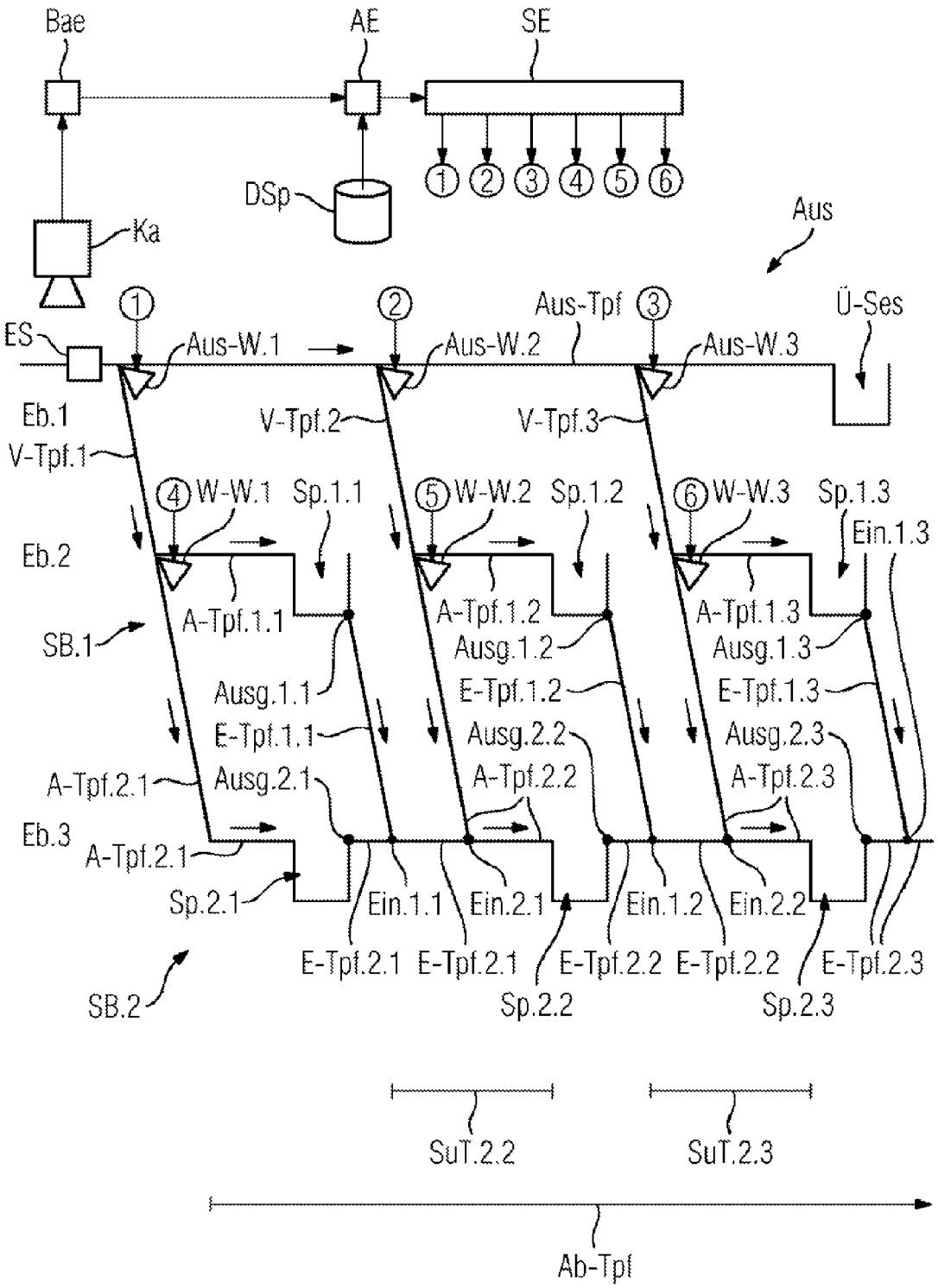
FIG. 4 shows the sorting system from FIG. 2 in the sorting destination-optimized mode and in the "fill" state.

FIG. 4 shows the sorting system of FIG. 2 in the sorting destination-optimized mode and in the "fill" state. Those components of the sorting system that are not used in this state and in this mode and state are illustrated in gray. The unused components include the emptying transport paths E-Tpf.1.1, E-Tpf.1.2, . . . and the lead-in points Ein.1.1, Ein.2.2, . . . .

Figure 6:
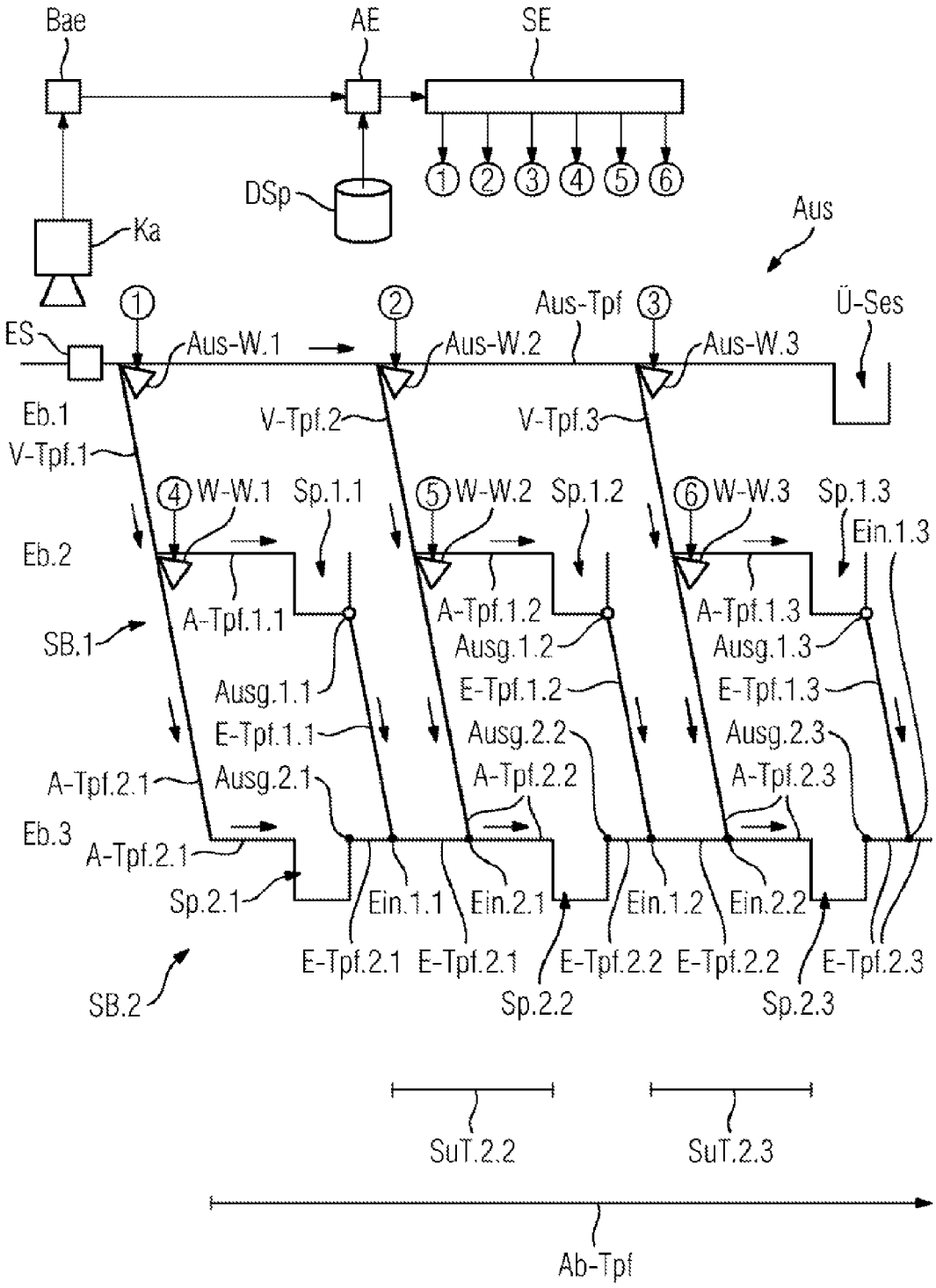
FIG. 6 shows the sorting system from FIG. 2 in the emptying-optimized mode and in the "fill" state.

FIG. 6 shows the sorting system from FIG. 2 in the emptying-optimized mode and in the "fill" state. Those components of the sorting system that are not used in this state and in this mode and state for this sorting task are illustrated in gray. Besides the emptying transport paths E-Tpf.1.1, E-Tpf.1.2, . . . and the lead-in points Ein.1.1, Ein.1.2, . . . , the storage devices Sp.2.1, Sp.2.2, . . . of the second storage area SB.2 are also not required in the situation of FIG. 6. In an embodiment the storage devices of the second storage area SB.2 are first emptied in the sorting destination-optimized mode and in the "empty" state. After this emptying, the entire removing path Ab-Tpf, with all now empty storage devices of the second storage area SB.2, is available to receive the postal items from the storage devices of the first storage area SB.1. In another embodiment at least one storage device Sp.1.*n* of the first storage area SB.1 is emptied before all the storage devices of the second storage area SB.2 that are arranged downstream of the lead-in point Ein.1.*n* into the removing path Ab-Tpf are emptied. In this case, space must be available in the removing path Ab-Tpf in order to receive the postal items from the storage device Sp.1.*n*. This space is provided between a lead-in point Ein.1.*n* and a subsequent storage device Sp.2.*m*+1 if the storage device Sp.2.*m*+1 has not yet been emptied.

In a third embodiment at least one storage device Sp.1.*n* of the first storage area SB.1 is emptied once all the storage devices of the second storage area SB.2 that are arranged downstream of the lead-in point Ein.1.*n* into the removing path Ab-Tpf have been emptied.

The case m=2 is now described, that is to say the case in which the selecting unit AE has selected a storage device Sp.2.*n* of the second storage area SB.2. The storage device Sp.2.*n* is arranged in the lower plane Eb.3 and is only then selected if the sorting system is operated in the sorting destination-optimized mode and the activated sorting plan assigns this storage device Sp.2.*n* the sorting feature value of the postal item. Also in the sorting destination-optimized mode, the selecting unit AE by contrast selects storage devices of the first storage are SB.1 for some of the postal items.

The path of the postal item to the forwarding diverter point W-W.n is the same as just described for the case m=1. However, the forwarding diverter point W-W.n forwards the postal item in the case m=2 into the issuing transport path A-Tpf.2.*n*, which conveys the postal item from the middle plane Eb.2 into the lower plane Eb.3, and further in the lower plane Eb.3 to the selected storage device Sp.2.*n*.

In the sorting destination-optimized mode and in the "fill" state, the storage devices Sp.2.1, Sp.2.2, . . . of the second storage area SB.2 are not used in an embodiment and are likewise deactivated or are used for another sorting task. The issuing transport paths A-Tpf.2.1, A-Tpf.2.2, . . . to these deactivated storage devices of the second storage area SB.2 are themselves deactivated.

As soon as all postal items to be sorted have been distributed between the storage devices, the sorting system is switched over in both modes from the "fill" state to the "empty" state. The operation of the sorting system in the sorting destination-optimized mode and in the "empty" state will be described first.

Figure 5:
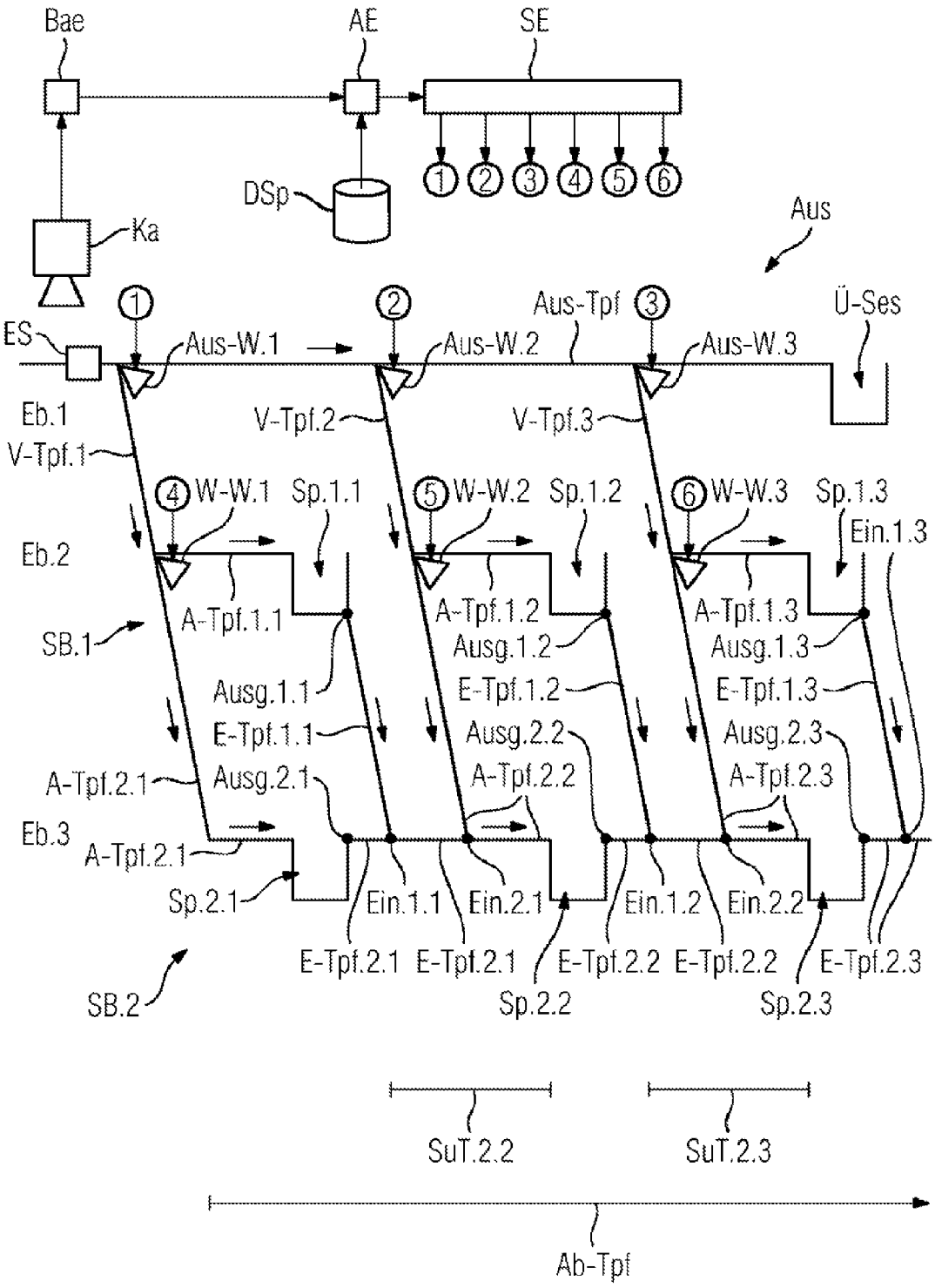
FIG. 5 shows the sorting system from FIG. 2 in the sorting destination-optimized mode and in the "empty" state.

FIG. 5 shows the sorting system from FIG. 2 in the sorting destination-optimized mode and in the "unload" state. Those components of the sorting system which are not used in this state and in this mode and state for this sorting task are illustrated in gray. This includes all components which are arranged upstream of all storage devices to be emptied, including the issuing transport paths A-Tpf.1.1, A-Tpf.1.2, . . . to the storage devices of the first storage area SB.1 and also portions of issuing transport paths A-Tpf.2.1, A-Tpf.2.2, . . . to the storage devices of the second storage area SB.2.

Both the storage devices Sp.1.1, Sp.1.2, . . . of the first storage area SB.1 and the storage devices Sp.2.1, Sp.2.2, . . . of the second storage area SB.2 are filled with postal items and are now to be emptied. All emptying transport paths E-Tpf.1.1, E-Tpf.2.1, . . . are activated with the switchover into the "emptying" mode. The portions of the output transport paths A-Tpf.2.2, A-Tpf.2.3, . . . to the storage devices Sp.2.1, Sp.2.2, . . . of the second storage area SB.2 that start at a lead-in point Ein.2.1, Ein.2.2, . . . or are arranged in the lower plane Eb.3 remain activated. The issuing transport path A-Tpf.2.1 is not used in this mode and state. These portions and the activated emptying transport paths E-Tpf.2.1, E-Tpf.2.2, . . . form a continuous removing path Ab-Tpf, which is arranged in the lower plane Eb.3 and is only used in the sorting destination-optimized mode. The storage and transport components SuT.2.2, SuT.2.3 likewise form components of the continuous removing path Ab-Tpf and are used as transport components.

In the "empty" state, all distribution paths A-Tpf.1.1 . . . to the storage devices Sp.1.1, Sp.1.2, . . . of the first storage area SB.1, all diverter points Aus-W.1, Aus-W.2, . . . , W-W.1, W-W.2, . . . the discharge transport path Aus-Tpf and those portions of the issuing transport paths A-Tpf.2.1, A-Tpf.2.2, . . . that do not belong to the continuous removing path Ab-Tpf are deactivated.

The storage devices Sp.1.1, Sp.1.2, . . . of the first storage area SB.1 are emptied via the store outputs Ausg.1.1, Ausg.2.1, . . . and the emptying transport paths E-Tpf.1.1, E-Tpf.1.2, . . . . These postal items reach the lead-in points Ein.1.1, Ein.1.2, . . . into the continuous removing path Ab- Tpf. The storage devices Sp.2.1, Sp.2.2, . . . of the second storage area SB.2 are emptied via the store outputs Ausg.2.1, Ausg.2.2, . . . . The emptying transport paths E-Tpf.2.1, E-Tpf.2.2, . . . belong to the continuous removing path Ab-Tpf.

All postal items from a storage device reach the removing path Ab-Tpf by this type of emptying in such a way that the postal items are arranged in direct succession in the removing path Ab-Tpf, without postal items from another storage device coming between the aforesaid postal items. The division of the postal items already attained between the storage devices is thus maintained. In an embodiment all storage devices in the removing path Ab-Tpf are first emptied, such that the removing path Ab-Tpf receives all postal items once. The removing path Ab-Tpf is then emptied. In another embodiment individual storage devices are emptied in succession into the removing path Ab-Tpf, and the removing path Ab-Tpf is then emptied repeatedly. It is possible for the removing path Ab-Tpf to then be emptied after each emptying of a storage device. In this case, a predetermined emptying sequence of the storage devices can be observed.

In the emptying-optimized mode and following switchover into the "fill" state, the storage devices Sp.2.1, Sp.2.2, . . . of the second storage area SB.2 and the output transport paths to these storage devices are not required. In an embodiment these storage devices are deactivated. In another embodiment the storage devices of the second storage area SB.2 are again filled with postal items from a prior sorting task and are emptied, whilst the storage devices of the first storage area SB.1 are filled in a temporally overlapping manner.

The operation in the emptying-optimized mode and in the "empty" state will now be described. As already mentioned, only the storage devices of the first storage area SB.1 are filled in the emptying-optimized mode and in the "fill" state. When switching over into the "empty" state the storage devices of the second storage area SB.2 are empty and therefore are available for filling.

Figure 7:
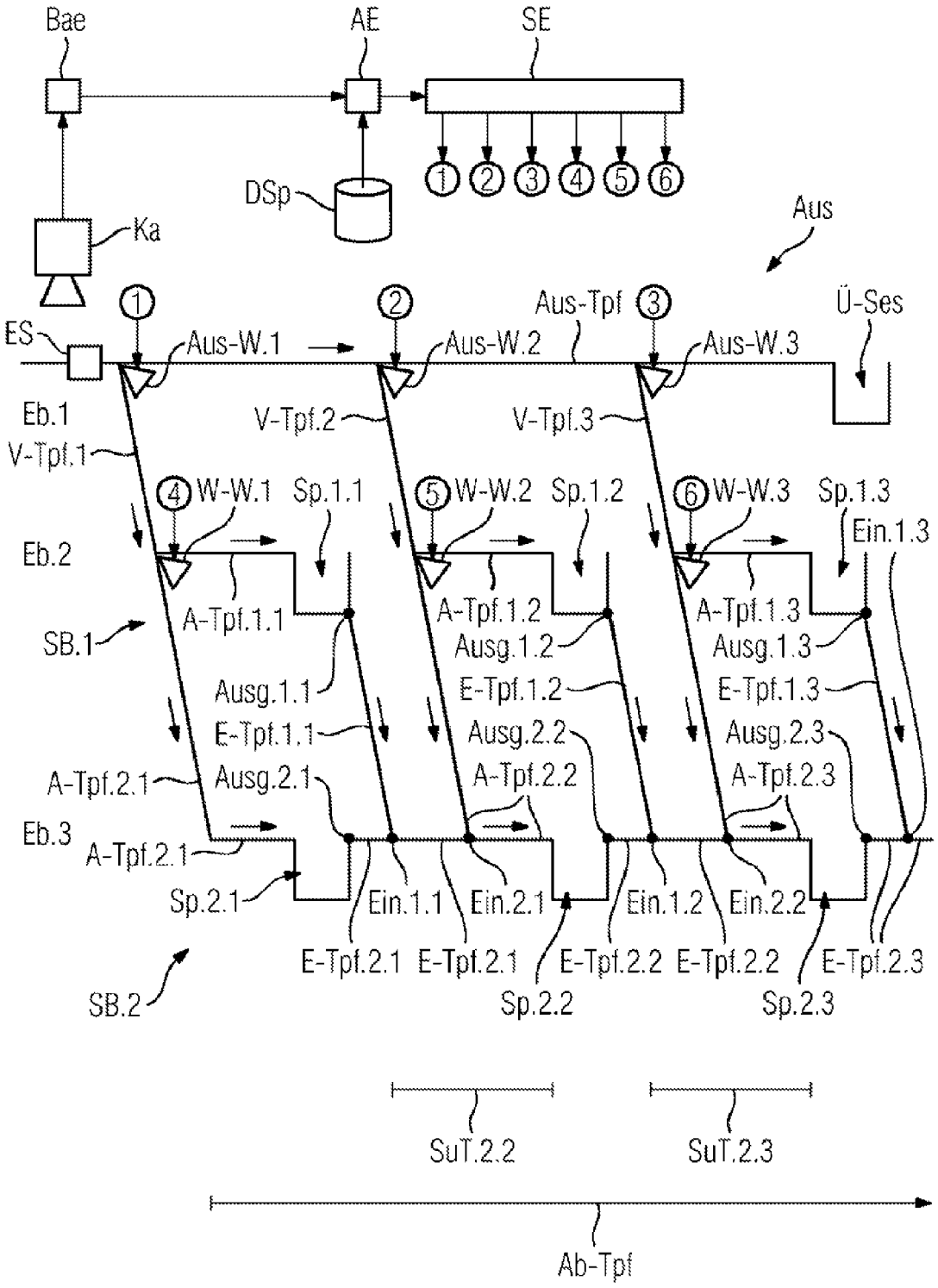
FIG. 7 shows the sorting system from FIG. 2 in the emptying-optimized mode and in the "empty" state.

FIG. 7 shows the sorting system from FIG. 2 in the emptying-optimized mode and in the "empty" state. Those components of the sorting system which are not used in this state and in this mode and state for this sorting task are illustrated in gray. The filled storage devices of the first storage area SB.1 are completely emptied in that the postal items are emptied from the storage device Sp.1.*n* via the store output Ausg.1.*n* and the emptying transport path E-Tpf.1.*n* into the storage device Sp.2.*n*+1 (n=1, 2, . . . ).

In the example of FIG. 6 and FIG. 7, the first storage device Sp.2.1 of the second storage area SB.2 is not used in the emptying-optimized mode, at least not in this sorting run. It is possible that postal items are still located in this first storage device Sp.2.1 due to a prior sorting run.

In the emptying-optimized mode and in the "empty" state, the storage device Sp.1.1 is emptied in the example of FIG. 7 into the storage device Sp.2.2, and the storage device Sp.1.2 is emptied into the storage device Sp.2.3. The storage device Sp.1.3 is emptied into a storage device Sp.2.4 (not shown) of the second storage area SB.2, said storage device being arranged downstream of the storage device Sp.2.3.

In an embodiment of the emptying-optimized mode, all storage devices of the first storage area SB.1 are emptied once. In another embodiment each storage device Sp.1.*n* of the first storage area SB.1 is then already emptied if it is certain that, during this sorting process, no further postal items are to be discharged into this storage device Sp.1.*n*. The storage device Sp.1.*n* is thus available as early as possible for a further subsequent sorting process. The storage and transport components SuT.2.2, SuT.2.3, . . . extend the respective subsequent storage device Sp.2.2, SP.2.3, . . . of the second storage area SB.2 and therefore function as storage device components in the emptying-optimized mode.

In an embodiment as many storage devices as possible in the second storage area SB.2 are used in the emptying-optimized mode and in the "empty" state. In this embodiment each storage device Sp.1.*n* of the first storage area SB.1 having a store output is emptied completely into a storage device of the second storage area SB.2, more specifically via the emptying transport path E-Tpf.1.*n*, which leads, at the lead-in point Ein.1.*n*, into the emptying transport path E-Tpf.2.*n*+1. The entire route from the discharge section Ein.1.*n* to the subsequent discharge section Ein.1.*n*+1 of the next emptying transport path E-Tpf.1.*n*+1 is available for receiving postal items from the storage device Sp.1.*n*.

LIST OF REFERENCE SIGNS

| Reference sign | Meaning |
|---|---|
| A-Tpf.1.1, A-Tpf.1.2, . . . | issuing transport paths, lead to the storage devices Sp.1.1, SP.1.2, . . . of the first storage area SB.1 |
| A-Tpf.2.1, A-Tpf.2.2, . . . | issuing transport paths, lead to the storage devices Sp.2.1, Sp.2.2, . . . of the second storage area SB.2 |
| Ab-Tpf | continuous removing path in the lower plane Eb.3, is formed in the sorting destination-optimized mode by the emptying transport paths E-Tpf.1.1, E-Tpf.2.2, . . . and the issuing transport paths A-Tpf.2.1, A-Tpf.2.2, . . . of the storage devices of the second storage area SB.2 |
| Abg-Sz | leaving sorting center, in the area of responsibility of which the sender locations AO.1, AO.2, AO.3 are located |
| AE | selecting unit, selects a storage device Sp.1.1, . . . , Sp.2.1 . . . for each postal item |
| AO.1, AO.2, . . . | sender locations for postal items, lie within the area of responsibility of the leaving sorting center Abg-Sz |
| Aus | discharge arrangement, transports a holding device with a postal item from the feeding station ES to the selected storage device Sp.1.1, . . . , Sp.2.1, . . . |
| Ausg.1.1, Ausg.1.2, . . . | store outputs of the storage devices Sp.1.1, Sp.1.2, . . . of the first storage area SB.1 |
| Ausg.2.1, Ausg.2.2, . . . | store outputs of the storage devices Sp.2.1, Sp.2.2, . . . of the second storage area SB.2 |
| Aus-Tpf | discharge transport path |
| Aus-W.1, Aus-W.2, . . . | discharge diverter points in the discharge transport path Aus-Tpf, discharge postal items from the discharge transport path Aus-Tpf, into the connection transport paths V-Tpf.1, V-Tpf.2, . . . |
| Bae | image evaluation unit, evaluates images of postal items in order to decipher destination point markings |
| DP.1.1, DP.1.2, . . . | delivery points of the delivery route ZR.1 |
| DP.2.1, DP.2.2, . . . | delivery points of the delivery route ZR.2 |
| DP.3.1, DP.3.2, . . . | delivery points of the delivery route ZR.3 |
| Eb.1 | upper plane of the discharge arrangement Aus, comprises the discharge transport path Aus-Tpf and the discharge diverter points Aus-W.1, Aus-W.2, . . . |
| Eb.2 | middle plane of the discharge arrangement Aus, comprises the storage devices Sp.1.1, Sp.1.2, . . . of the first storage area SB.1, the issuing |

-continued

| Reference sign | Meaning |
|---|---|
| | transport paths A-Tpf.1.1, A-Tpf.1.2 to these storage devices, and the forwarding diverter points W-W.1, W-W.2 . . . |
| Eb.3 | lower plane of the discharge arrangement Aus, comprises the removing path Ab-Tpf with the storage devices Sp.2.1, Sp.2.2, . . . of the second storage area SB.2 |
| E-Tpf.1.1, E-Tpf.1.2, . . . | emptying transport paths for the storage devices of the first storage area SB.1, start at the store outputs Ausg.1.1, Ausg.1.2, . . . and discharge at the lead-in points Ein.1.1, Ein.1.2, . . . into the emptying transport paths E-Tpf.2.1, E-Tpf.2.2, . . . |
| E-Tpf.2.1, E-Tpf.2.2, . . . | emptying transport parts for the storage devices of the second storage area SB.2, start at the store outputs Ausg.2.1, Ausg.2.2, . . . and discharge at the lead-in points Ein.2.1, Ein.2.2, . . . into the issuing transport paths A-Tpf.2.2, A-Tpf.2.3, . . . |
| Ein.1.1, Ein.1.2, . . . | lead-in points, at which the emptying transport paths E-Tpf.1.1, E-Tpf.1.2, . . . discharge into the emptying transport paths E-Tpf.2.1, E-Tpf 2,2, . . . |
| Ein.2.1, Ein.2.2, . . . | lead-in points, at which the emptying transport paths E-Tpf.2.1, E-Tpf.2.2, . . . discharge into the issuing transport paths A-Tpf.2.1, A-Tpf.2.2, . . . |
| Eing-Sz.1 | entering sorting center, in the area of responsibility of which the delivery points of the delivery routes ZR.1 and ZR.2 are located |
| Eing-Sz.2 | entering sorting center, in the area of responsibility of which the delivery points of the delivery route ZR.3 are located |
| ES | feeding station for feeding postal items into holding devices and for feeding filled holding devices into the discharge transport path Aus-Tpf |
| Fs.1, Fs.2 | parallel guide rails, from which the storage device pocket Spt hangs |
| Hal | mounting of the storage device pocket Spt |
| Ke-Sp | machine-readable identifier on the mounting Hal |
| Kl.Sp | flap at the base of the storage device pocket Spt |
| Kp.1, Kp.2 | coupling elements of the storage device pocket Spt in the form of two clips |
| Ps | flat postal item between the side face Sf.1, Sf.2 of the storage device pocket Spt |
| SB.1 | first storage area with the storage devices Sp1.1, Sp1.2, . . . , located in the middle plane Eb.2 |
| SB. 2 | second storage area with the storage devices Sp.2.1, Sp.2.2, . . . , located in the lower plane Eb.3 |
| SB.a, SB.b | lateral delimiting planes between the side faces Sf.1, Sf.2 of the storage device pocket Spt |
| SE | control unit |
| Sf.1, Sf.2 | side faces of the storage device pocket Spt, hang on the mounting Hal |
| Sp.1.1, Sp.1.2, . . . | storage devices of the first storage area SB.1 |
| Sp.2.1, Sp.2.2, . . . | storage devices of the second storage area SB.2 |
| Spt | holding device in the form of a storage device pocket for the postal item Ps |
| SuT.2.2, SuT.2.3 | storage and transport components in the second storage area SB.2 |
| Ü-Sp | overflow storage device |
| V-Tpf.1, V-Tpf.2, . . . | connection transport paths, connect the discharge diverter points Aus-W.1, Aus-W.2, . . . to the forwarding diverter points W-W.1, W-W.2, . . . |
| W-W.1, W-W.2, . . . | the storage devices of the first storage area SB.1 and the issuing transport paths A-Tpf 2.1, A-Tpf.2.2 to the storage devices of the second storage area SB.2 start |
| ZR.1, ZR.2 | delivery routes in the delivery area of the entering sorting center Eing-Sz.1 |
| ZR.3 | delivery route in the area of responsibility of the entering sorting center Eing.Sz.2 |

The invention claimed is:

1. A sorting system for sorting objects according to a predetermined sorting feature, the sorting system comprising:

a first storage area and a second storage area spatially separate from one another and each having a plurality of storage devices connected in series;

each of said plurality of storage devices being configured to receive a number of objects to be sorted, and to be emptied by removing and/or transporting away the objects;

at least two of said storage devices of said first storage area having a store output and an emptying transport path connecting said store output to a respective storage device of said second storage area;

a measuring apparatus configured to measure, for an object to be sorted, a value which a sorting feature takes on for the said object, a selecting unit configured to automatically select, for an object to be sorted, a respective said storage device of the sorting system depending on a measured sorting value of the said object;

a discharge arrangement configured to transport the said object to be transported to said storage device selected for the said object and to discharge the said object into said storage device; and a control unit configured for communicating with said selecting unit and for controlling said discharge arrangement in a manner causing the sorting system to operate in an emptying-optimized mode and additionally in a sorting destination-optimized mode;

said selecting unit being configured, with operation of the sorting system in the emptying-optimized mode, to select, for each object to be sorted, a storage device of the first storage area having a store output depending on the measured sorting feature value;

said discharge arrangement being configured, with operation of the sorting system in the emptying-optimized mode, to completely empty each storage device having a store output in that said discharge arrangement transports the objects from the said storage device via said store output and said emptying transport path of the said storage device into a storage device of said second storage area; and said selecting unit being configured, with operation of the sorting system in the sorting destination-optimized mode, to select, when selecting storage devices for the objects to be sorted, storage devices of said first storage area and storage devices of said second storage area.

2. The sorting system according to claim 1, wherein:

at least one emptying transport path, which connects a store output of a storage device of said first storage area to a storage device of said second storage area, leads into a storage and transport component;

said discharge arrangement is configured, with operation in the emptying-optimized mode, when emptying the said storage device of said first storage area, to use said storage and transport component as an extension of the said storage device of said second storage area and said discharge arrangement is further configured, when emptying a storage device of said second storage area to transport at least one object through said storage and transport component.

3. The sorting system according to claim 1, which comprises a plurality of controllable forwarding diverter points each having an input and at least two outputs and being enabled to selectively steer an object to be sorted into the one output or into the other output, and wherein:

an issuing transport path leads to each selectable storage device and starts at an output of a forwarding diverter point;

an issuing transport path to a selectable storage device of said first storage area starts at the one output of a forwarding diverter point;

an issuing transport path to a selectable storage device of said second storage area starts at the other output of said forwarding diverter point; and a connection transport path leads to each input of each forwarding diverter point.

4. The sorting system according to claim 1, wherein:

each said storage device is configured such that objects to be sorted can be brought from the said storage device into a receiving unit;

the sorting system is configured, with operation in the emptying-optimized mode, to empty each storage device of said first storage area in each case into one storage device of said second storage area; and the sorting system is further configured, with operation in the sorting destination-optimized mode, for the objects from one storage device to be brought into a receiving unit.

5. The sorting system according to claim 1, which comprises a removing conveying arrangement configured, when a storage device of said second storage area is being emptied, to transport away the objects.

6. The sorting system according to claim 5, wherein each selectable storage device of said second storage area forms a portion of said removing conveying arrangement.

7. The sorting system according to claim 1, which comprises a number of holding devices each configured to receive at least one object to be sorted and to hold the object temporarily, and wherein the sorting system is configured to transport a holding device with an object to be sorted to the respective said storage device selected for the object.

8. A sorting method for sorting objects according to a predetermined sorting feature, comprising:

providing a sorting system with a first storage area and a second storage area, wherein the first storage area is spatially separate from the second storage area, and both the first storage area and the second storage area have a plurality of storage devices connected in series, wherein at least two of the storage devices of the first storage area has a store output and an emptying transport path connecting the store output to a respective storage device of the second storage area; and performing the following steps for each object to be sorted:

measuring a value which the sorting feature takes on for the given object;

automatically selecting a storage device depending on the measured sorting feature value;

transporting the object to the storage device selected for this object; and discharging the object into the selected storage device, and later emptying each storage device selected for at least one object;

at least temporarily operating the sorting system in an emptying-optimized mode and at least temporarily operating the sorting system in a sorting destination-optimized mode:

in the emptying-optimized mode, selecting for each object to be sorted a storage device of the first storage area having a store output, and completely emptying each selectable storage device of the first storage area having a store output, by transporting the objects completely from the storage device via the store output and the emptying transport path of the storage device into a storage device of the second storage area, and in the sorting destination-optimized mode, selecting for at least one object to be sorted a storage device of the first storage area having a store output, and selecting for at least one further object to be sorted a storage device of the second storage area.

9. The sorting method according to claim 8, which comprises, during operation in the sorting destination-optimized mode, emptying each storage device of the first storage area and each storage device of the second storage area by bringing the objects from the respective storage device into at least one receiving unit.

* * * * *